United States Patent [19]

Calandra, Jr.

[11] Patent Number: 4,934,873

[45] Date of Patent: Jun. 19, 1990

[54] MINE ROOF SUPPORT UTILIZING ROOF ANCHORS HAVING EYE-BOLT HEADS

[75] Inventor: Frank Calandra, Jr., Pittsburgh, Pa.

[73] Assignee: Jennmar Corporation, Pittsburgh, Pa.

[21] Appl. No.: 229,705

[22] Filed: Aug. 8, 1988

[51] Int. Cl.[5] ..... E21D 21/00

[52] U.S. Cl. ..... 405/288; 405/259

[58] Field of Search ..... 405/259–261, 405/288

[56] References Cited

U.S. PATENT DOCUMENTS

| | | | |
|---|---|---|---|
| 1,559,560 | 11/1925 | Doughty | 405/288 X |
| 2,667,037 | 1/1954 | Thomas et al. | 405/260 |
| 3,427,811 | 2/1969 | White | 138/147 |
| 3,455,200 | 7/1969 | Cumming | 411/22 |
| 3,504,498 | 4/1970 | Triplett | 405/259 X |
| 3,505,824 | 4/1970 | White | 405/259 |
| 3,509,726 | 5/1970 | White | 405/259 |
| 3,651,651 | 3/1972 | Triplett | 411/34 |
| 4,274,762 | 6/1981 | Johnson | 405/288 X |
| 4,349,300 | 9/1982 | Kelley | 405/288 |
| 4,395,161 | 7/1983 | Wilson et al. | 405/259 |
| 4,413,930 | 11/1983 | Calandra Jr. | 405/261 |
| 4,419,805 | 12/1983 | Calandra Jr. | 29/458 |
| 4,596,496 | 6/1986 | Tyrell et al. | 405/259 X |
| 4,601,616 | 7/1986 | Barish et al. | 405/288 |
| 4,634,318 | 1/1987 | Koumal | 405/259 |
| 4,634,326 | 1/1987 | Fischer | 405/259 X |

*Primary Examiner*—Randolph A. Reese
*Assistant Examiner*—Arlen L. Olsen
*Attorney, Agent, or Firm*—Stanley J. Price, Jr.

[57] ABSTRACT

A roof support for an underground mine or the like is disclosed. The roof support is comprised of two roof anchors that are secured in bore holes formed in the mine roof with a cross member tensioned between the roof anchors. The roof anchors have eye-bolt heads formed on the ends which protrude from the roof and to which the cross member is readily secured. A tensioning means is provided to tension the cross member and the major portion of the cross member may be either a rigid metal rod or a flexible wire rope cable. The present invention also provides for a roof anchor that is formed from concrete reinforcing bar which has an eye-bolt head that is hot forged onto the reinforcing bar.

11 Claims, 1 Drawing Sheet

MINE ROOF SUPPORT UTILIZING ROOF ANCHORS HAVING EYE-BOLT HEADS

BACKGROUND OF THE INVENTION

1. Field Of The Invention

This invention relates to an improved roof support for an underground mine or the like, and more specifically to a roof support which utilizes a horizontal cross member to provide tension between a pair of roof anchors that are fixed into bore holes formed in the roof.

2. Description Of The Prior Art

Numerous methods and structures have been provided for supporting the roof of mines or other underground passages. One type of structure, which is commonly employed, includes a roof truss which generally provides two inclined cords and a horizontal cord. The inclined cords are usually mine roof bolts or roof anchors which extend into holes in the mine roof at about a 45° angle to the vertical. The mine roof bolts may be anchored in the inclined holes in the roof by well known means such as mechanical expansion shells, resin bonding, or a combination of mechanical expansion shells and resin bonding. The horizontal cord or cross member extends across the mine roof between the roof anchors. The horizontal cord applies tension between the roof anchors to generate an upward force on the roof and provided stability to the roof.

U.S. Pat. No. 2,667,037 discloses a general roof support system which provides the type of upward forces described above. Specifically, a horizontal beam is positioned transversely of the mine opening across the roof and is retained in placed by a plurality of inclined bolts which anchor the horizontal beam and provide over-all integrity for the roof support.

U.S. Pat. No. 3,427,811 discloses a system which provides the same type of upward forces to support a mine roof but includes the additional features of a means for varying the tension on the horizontal cord or cross member. U.S. Pat. No. 3,505,824 and U.S. Pat. No. 3,509,726 disclose roof support trusses similar to U.S. Pat. No. 3,427,811 but which employ different elements to create a combined tension on the inclined cord and the horizontal cord components.

U.S. Pat. No. 4,395,161 describes a roof plate utilized in the truss type systems described above. U.S. Pat. No. 4,601,616, assigned to the assignee herein, discloses a roof support of the type generally described above which includes a tool for tensioning the cross member or horizontal cord.

U.S. Pat. No. 3,455,200 discloses a roof anchor that has an eyelet on the outer end. The eyelet is utilized to retain a cross piece that holds wire mesh screening in place to cover the roof and walls of a mine passage.

SUMMARY OF THE INVENTION

In accordance with the present invention, there is provided a roof support for an underground mine passage or the like which has first and second mine roof anchors secured in the mine passage roof in spaced relation to each other. Each of the mine roof anchors has an eye-bolt head formed on the shaft of the anchor. A cross member is secured to the eye-bolt heads of each of the roof anchors and the cross member includes tension means to produce tension in the cross member between the first and second roof anchors.

Further, in accordance with the present invention, there is provided a roof support for an underground mine passage or the like which has first and second mine roof anchors secured in the mine passage roof in spaced relation to each other. Each of the roof anchors has an eye-bolt head formed on the shaft of the anchor and the eye-bolts protrude from the mine passage roof. A cross member is secured at each end to the eye-bolt heads of the respective roof anchors. The cross member includes a tension-producing bolt and nut connected to an elongated structural member so that the bolt is connected to the first roof anchor eye-bolt head and the elongated structural member is connected to the second roof anchor eye-bolt head. The cross member tension-producing bolt and nut made be tightened to place the cross member in tension between the eye-bolt heads of the respective roof anchors.

Still further in accordance with the present invention, there is provided a mine roof anchor made up of a concrete reinforcing bar having an eye-bolt head integrally formed on the end of the reinforcing bar and having means cooperating with the reinforcing bar to secure the reinforcing bar within a hole bored in the mine roof.

It is a primary object of the present invention to provide an improved roof support which can be simply and easily installed and adjusted.

Another object of the present invention is to provide a roof support utilizing a novel roof anchor having an eye-bolt head hot forged thereon.

Still another object of the present invention is to provide a novel mine roof anchor formed from a concrete reinforcing bar that had an eye-bolt head hot forged thereon.

These and other objects of the present invention will become apparent as this description proceeds in conjunction with the accompanying drawings and appended claims.

DESCRIPTION OF THE PREFERRED EMBODIMENTS

Figure 1:
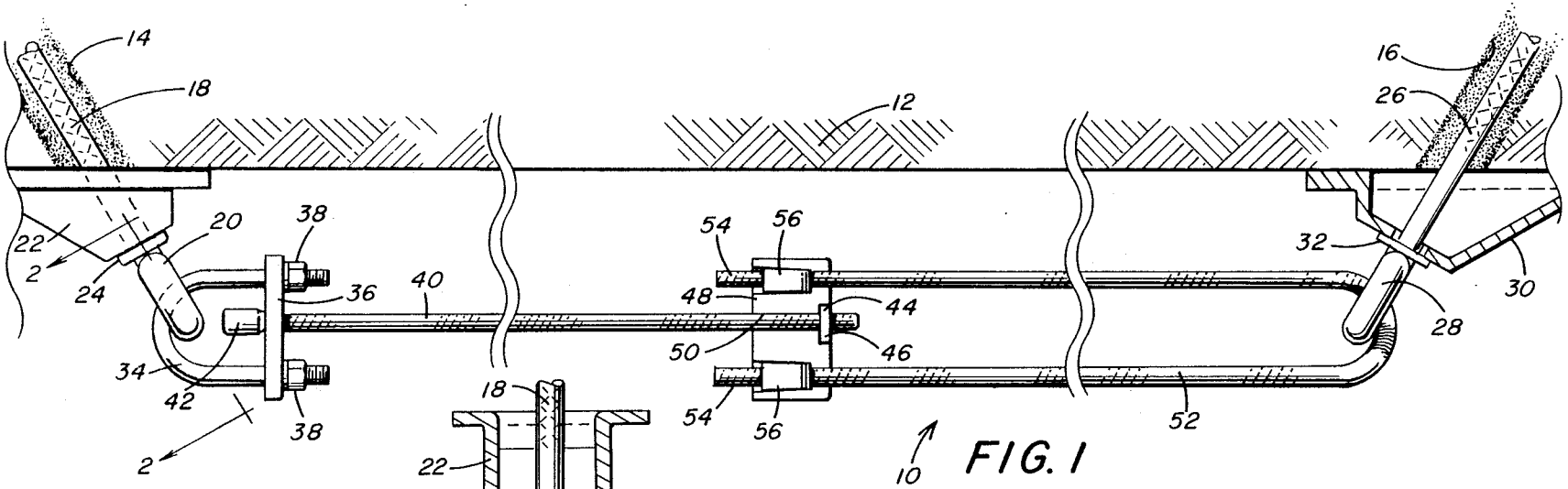
FIG. 1 is an elevational view in partial section of a mine passage having the improved roof support of the present invention installed thereon.

As seen in FIG. 1, a roof support indicated generally at 10 is installed to support the roof 12 of an underground mine passage or the like. Bore holes 14 and 16 are formed in the roof 12 at an angle of between 35° and 55° to the vertical and preferably at an angle of 45° to the vertical. Bore holes 14 and 16 are preferably aligned and in the same plane.

A first mine roof anchor 18 is disposed in bore 14. Roof anchor 18 has a shaft formed from steel concrete reinforcing bar with an eye-bolt head 20 hot forged on the end of the roof anchor 18. The hot forging of the eyebolt head 20 on the reinforcing bar provides greater strength for the roof anchor 18 than if the eye-bolt head were welded onto the reinforcing bar or formed by bending the bar to the head. The eye bolt head 20 has a unitary endless circular configuration so that the eye bolt head 20 is capable of withstanding a tensile force as great as the tensile force of the shaft of the roof anchor 18 is capable of withstanding.

In conventional fashion, the mine roof anchor 18 is retained in bore 14 by use of a conventional mechanical expansion shell (not shown) placed on the end of it, or by resin which adheres to the interior of the bore and to the reinforcing bar shaft 18, or by a combination of a mechanical expansion shell and resin which cooperate to secure the shaft of roof anchor 18 within bore 14. Examples of mine roof anchors utilizing a combination of a mechanical expansion shell and resin to secure the anchors within bore holes are disclosed in U.S. Pat. No. 4,413,930 and U.S. Pat. No. 4,419,805, assigned to the assignee herein.

A roof support plate 22 is held against the roof 12 by the head 20 of roof anchor 18. A washer 24 is interposed between the head 20 and plate 22 to facilitate turning of the anchor 18 relative to plate 22 during installation of anchor 18.

At the opposite side of the mine roof 12, a second roof anchor 26 having an eye-bolt head 28 is secured within bore 16 in the manner that is described in connection with anchor 18. The second mine roof anchor 26 retains a roof support plate 30 against the mine roof 12. Washer 32 is interposed between the eye-bolt head 28 and plate 30.

Figure 2:
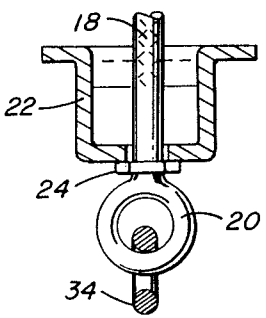
FIG. 2 is a section view taken along line 2—2 of FIG. 1 and showing the eye-bolt head of the roof anchor.

Still referring to FIGS. 1 and 2, a "U" bolt 34 is passed through the eye of bolt head 20 and bolted to a retainer 36 by means of nuts 38 on "U" bolt 34. A tension bolt 40 having a head 42 and a nut 44 threaded onto it, is freely received through a bore in retainer 36.

The nut 44 threaded onto tensioning bolt 40 is received within hexagonal recess 46 formed in holder 48. A bore 50 in holder 48 permits the tension bolt 40 to move freely through holder 48.

An elongated structural member 52 that has end 54 is doubled back upon itself in a manner so that elongated structural member 52 passes through the eye of bolt head 28. The ends 54 of structural member 52 are retained within the holder 48 by means of securing means 56 which may be clamps, threads, or welds as required depending upon the nature of structural member 52. Structural member 52 may be formed as either a rigid metal rod which is turned back upon itself in the shape of an elongated "U" or elongated structual member 52 may be formed from flexible wire rope cable.

The "U" bolt 34, retainer 36, tension bolt 40 with nut 44, holder 48 and elongated structural member 52 together form the cross member which connects the eye-bolt head 20 of first mine roof anchor 18 to the eye-bolt head 28 of second roof anchor 26.

It will be seen that by tightening tension bolt 40 through nut 44, the eye-bolt head 20 and the eye-bolt head 28 tend to be drawn toward one another to place tension in the cross member thereby facilitating roof control.

Figure 3:
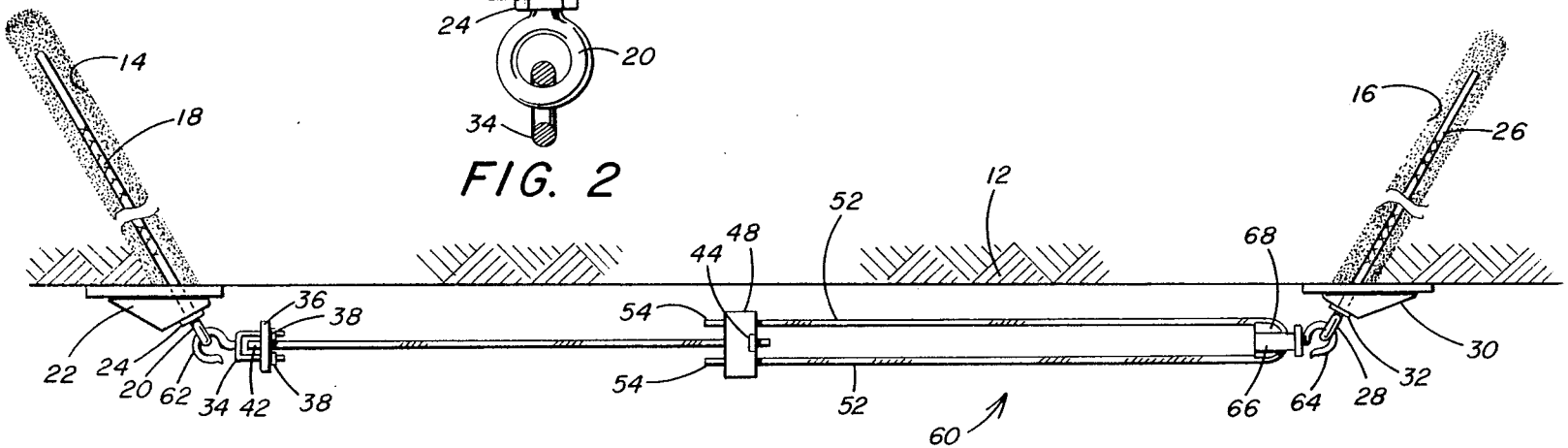
FIG. 3 is an elevational view similar to FIG. 1 showing a preferred embodiment of the roof support of the present invention.

FIG. 3 shows a modified version indicated generally at 60 of the roof support 10 which has been described in connection with FIGS. 1 and 2. In roof support 60, all of the items which appear in both roof support 10 and roof support 60 have been given the same reference numerals throughout. A description of those items which are identical for both configurations will not be repeated here.

In roof support 60, a hook 62 is secured to "U" bolt 34 so that hook 60 may be placed through eye-bolt head 20 rather than having "U" bolt 34 pass directly through the eye-bolt head 20 as in FIGS. 1 and 2.

Similarly, a second hook 64 is fixed to a fork 66 which carries a semi-circular block 68 between the prongs of the fork 66. The block 68 has a groove (not shown) around the complete periphery of the semi-circle to receive the bend in elongated structural member 52. The hook 64 passes through the eye-bolt head 28 to secure the elongated structural member 52 to anchor 26. Once first hook 62 and second hook 64 are inserted through eye-bolt heads 20 and 28, respectively, the roof support 60 is operated in the same manner as roof support 10. It will be appreciated that the cross member of roof support 60 which also includes hooks 62 and 64 can be more easily placed upon the roof anchors than can the cross member of roof support 10.

The present invention also provides a novel roof anchor formed from steel concrete reinforcing bar that has a eye-bolt head hot forged on it. The steel concrete reinforcing bar can utilize either a mechanical anchor, resin retention of the reinforcing bar within the bore, or a combination of a mechanical expansion anchor and resin to hold the roof anchor firmly within the bore.

According to the provisions of the Patent Statutes, I have explained the principle, preferred construction and mode of operation of my invention and have illustrated and described what I now consider to represent its embodiment. However, it should be understood that, within the scope of the apended claims, the invention may be practiced otherwise than as specifically illustrated and described.

I claim:

1. A roof support for an underground mine passage or the like comprising:

first and second mine roof anchors secured in said mine passage roof in spaced relation to each other, each of said anchors having a unitary endless circular eye bolt head formed by forging the end of said shaft of said anchor whereby said unitary eye bolt head is capable of withstanding a tensile force as great as the tensile force said shaft is capable of withstanding;

said first and second mine roof anchor shafts each being formed from a cylindrical concrete reinforcing bar;

a cross member secured directly to said eye-bolt head of each of said first and second mine roof anchors and not to the bearing plates of said roof anchors, said cross member including tension means to provide tension in said cross member between said first and second anchors.

2. The roof support of claim 1 wherein said cross member tension means is formed of a bolt and nut that, when tightened, produce tension in said cross member between said first and second anchor eye-bolt heads.

3. The roof support of claim 1 wherein said roof anchors are secured in bore holes that are formed in said roof at an angle of between 35° and 55° from the vertical.

4. The roof support of claim 1 wherein said roof anchors and said cross member are all in the same plane when said roof support is installed to support said roof.

5. A roof support for an underground mine passage or the like comprising:

first and second mine roof anchors secured in said mine passage roof in spaced relation to each other, each of said anchors having a unitary endless circular eye bolt head formed by forging the end of said shaft of said anchor whereby said unitary eye bolt head is capable of withstanding a tensile force as great as the tensile force said shaft is capable of withstanding and said eye bolt head protruding from said mine passage roof;

said first and second mine roof anchor shafts each being formed from a cylindrical concrete reinforcing bar;

a cross member secured at each end directly to said eye-bolt head of each of said first and second roof anchors and not to the bearing plates of said roof anchors;

said cross member comprising a tension-producing bolt and nut connected to an elongate structural member whereby said bolt is connected to said first roof anchor eye-bolt head and said structural member is connected to said second roof anchor eye-bolt head so that said cross member tension-producing bolt and nut may be tightened to place said cross member in tension between said first roof anchor eye-bolt head and said second roof anchor eye-bolt head.

6. The roof support of claim 5 wherein said cross member elongated structural member is formed of a rigid steel rod.

7. The roof support of claim 5 wherein said cross member elongated structural member is formed of a flexible wire rope cable.

8. The roof support of claim 5 said tension-producing bolt is connected to a "U" bolt that passes through said first mine roof anchor eye-bolt head and said elongated structural member is formed with a loop that passes through said second mine roof anchor eye-bolt head.

9. The roof support of claim 5 wherein said tension-producing bolt is connected to a first hook that passes through said first mine roof anchor eye-bolt head and said elongated structural member is connected to a second hook that passes through said second mine roof anchor eye-bolt head.

10. The roof support of claim 5 wherein said roof anchors are secured in bore holes that are formed in said roof at an angle of between 35° and 55° from the vertical.

11. The roof support of claim 5 wherein said roof anchors and said cross member are all in the same plane when said roof support is installed to support said roof.

* * * * *